US005691755A

United States Patent [19]

Pawlowski, Jr. et al.

[11] Patent Number: 5,691,755

[45] Date of Patent: Nov. 25, 1997

[54] COLLAPSIBLE INK CARTRIDGE

[75] Inventors: Norman E. Pawlowski, Jr.; Bruce Cowger, both of Corvallis, Oreg.

[73] Assignee: Hewlett-Packard Company, Palo Alto, Calif.

[21] Appl. No.: 229,047

[22] Filed: Apr. 18, 1994

[51] Int. Cl.[6] ..... B41J 2/175

[52] U.S. Cl. ..... 347/86

[58] Field of Search ..... 347/86, 85, 7; 206/218; 220/666, 667; 229/108.1, 117.05

[56] References Cited

U.S. PATENT DOCUMENTS

| | | | |
|---|---|---|---|
| D. 341,157 | 11/1993 | Kitahara et al. | D18/36 |
| 3,438,058 | 4/1969 | Davis | 346/140 |
| 4,217,058 | 8/1980 | Straszewski et al. | 401/135 |
| 4,272,773 | 6/1981 | Halasz . | |
| 4,383,263 | 5/1983 | Ozawa et al. . | |
| 4,422,084 | 12/1983 | Saito | 347/7 |
| 4,429,320 | 1/1984 | Hattori et al. | 347/86 |
| 4,432,005 | 2/1984 | Duffield et al. | 347/7 |
| 4,480,259 | 10/1984 | Kruger et al. . | |
| 4,496,959 | 1/1985 | Frerichs | 347/86 |
| 4,509,062 | 4/1985 | Low et al. | 347/87 |
| 4,673,955 | 6/1987 | Ameyama et al. | 347/86 |
| 4,677,447 | 6/1987 | Nielsen . | |
| 4,689,642 | 8/1987 | Sugitani | 347/87 |
| 4,714,937 | 12/1987 | Kaplinsky | 347/86 |
| 4,771,295 | 9/1988 | Baker et al. . | |
| 4,777,497 | 10/1988 | Nozu et al. . | |
| 4,790,361 | 12/1988 | Jones et al. | 220/666 |
| 4,794,409 | 12/1988 | Cowger et al. | 347/87 |
| 4,831,389 | 5/1989 | Chan . | |
| 4,849,773 | 7/1989 | Owatari | 347/100 |
| 4,920,362 | 4/1990 | Cowger . | |
| 4,928,126 | 5/1990 | Asai | 347/86 |
| 4,935,751 | 6/1990 | Hamlin | 347/86 |
| 4,959,667 | 9/1990 | Kaplinsky . | |
| 4,961,076 | 10/1990 | Cowger . | |
| 4,992,802 | 2/1991 | Dion et al. | 347/87 |
| 4,998,115 | 3/1991 | Nevarez et al. . | |
| 5,010,354 | 4/1991 | Cowger et al. . | |
| 5,040,001 | 8/1991 | Dunn et al. | 347/86 |
| 5,040,002 | 8/1991 | Pollacek et al. . | |
| 5,113,199 | 5/1992 | Chan et al. . | |
| 5,126,767 | 6/1992 | Asai | 347/86 |
| 5,146,243 | 9/1992 | English et al. . | |
| 5,153,612 | 10/1992 | Dunn et al. | 347/87 |
| 5,185,614 | 2/1993 | Courian et al. . | |
| 5,187,498 | 2/1993 | Burger | 347/86 |
| 5,270,739 | 12/1993 | Kitani et al. | 347/86 |
| 5,574,489 | 11/1996 | Cowger et al. | 347/86 |

FOREIGN PATENT DOCUMENTS

| | | | |
|---|---|---|---|
| 0437363 | 7/1991 | European Pat. Off. | B41J 2/175 |
| 0490545 | 6/1992 | European Pat. Off. | B41J 2/17 |
| 0560398 | 9/1993 | European Pat. Off. | B41J 2/175 |
| 560398A2 | 9/1993 | European Pat. Off. | 347/86 |
| 0604119 | 6/1994 | European Pat. Off. | B41J 2/175 |
| 0604128 | 6/1994 | European Pat. Off. | B41J 2/175 |
| 0633137 | 1/1995 | European Pat. Off. | B41J 2/175 |
| 52-121062 | 6/1987 | Japan | B41J 3/04 |
| 1141751 | 6/1989 | Japan | B41J 3/04 |
| 1141752 | 6/1989 | Japan | B41J 3/04 |
| 2 063 175 | 6/1981 | United Kingdom . | |

*Primary Examiner*—Benjamin R. Fuller
*Assistant Examiner*—Judy Nguyen

[57] ABSTRACT

An ink cartridge has a body comprised of a plurality of wall panels that are resiliently hinged to adjacent wall panels. The wall panels define a cavity within the body for storing ink when the body is in a full configuration. The body collapses from the full configuration to an empty configuration as ink is removed from the body. The wall panels collapse inwardly about the hinges to lie flat against one another to reduce the cavity volume. A frame frames the plurality of wall panels of the body. The frame resiliently expands as the wall panels collapse flat together within the frame. The resilient expansion of the frame and the panel collapse about the hinges biases the body toward the full configuration.

18 Claims, 2 Drawing Sheets

COLLAPSIBLE INK CARTRIDGE

TECHNICAL FIELD

The present invention is directed to an ink cartridge that stores ink for a pen of an ink-jet type printer.

BACKGROUND INFORMATION

One type of ink-jet printer includes a carriage that is reciprocated back and forth across a sheet of paper that is advanced through the printer. The reciprocating carriage holds a pen very close to the paper. The pen is controlled by the printer for selectively ejecting ink drops from the pen while the pen is reciprocated or scanned across the paper, thereby to produce characters or an image on the paper.

The pen has a reservoir for holding a limited amount of ink. A relatively larger supply of ink is provided in a replaceable stationary container that is mounted to the printer. A tube is connected between the supply container and the pen, thereby to conduct the flow of ink from the supply container to the pen for replenishing the pen reservoir as needed. Alternatively, the tube may be normally unconnected to the pen, with the tube and pen being periodically coupled to replenish the pen reservoir.

Important design considerations for such stationary ink containers are low material, production, and packaging costs. The container should also be compact to facilitate container storage within the printer. The volume of empty ink containers should be minimized to facilitate handling during recycling or disposal. Such ink containers should also maximize the amount of ink that can be removed from the container.

SUMMARY OF THE INVENTION

The present invention is directed to a collapsible ink cartridge for storing ink and that is inexpensive to manufacture and package.

The cartridge of the present invention is compact and is shaped so that, upon collapse, substantially all of the stored ink may be removed.

The cartridge of the present invention also provides an ink cartridge that can retain ink under a partial vacuum or back pressure relative to the ambient, thereby preventing leakage from an inactive pen in applications where the tube is always connected to the pen.

The cartridge of the present invention also, in applications where the tube is periodically coupled with the pen, provides for the sucking-back of ink near the outlet opening of the tube when the tube is uncoupled from the pen after refilling.

The ink cartridge has a collapsible body that preferably is constructed out of a single material. The body has a plurality of planar wall panels that are hinged together. The body has a full configuration wherein the wall panels define a cavity within the body for storing ink. The body wall panels collapse together to an empty configuration to permit the removal of substantially all of the ink stored within the body, and to yield a thin profile for the empty cartridge. The wall panels include relatively large planar upper and lower wall panels that define the cartridge top and bottom so that the cartridge may be stacked. The hinges between the wall panels are resiliently formed to bias the upper and lower wall panels away from each other to store ink under a back pressure even as the body collapses during ink removal. In applications where the cartridge has a tube that is periodically coupled to a pen for refilling, the bias causes ink located near the open end of the tube to be sucked-back deeper into the tube as the tube is uncoupled from the pen.

DESCRIPTION OF PREFERRED EMBODIMENTS

Figure 1:
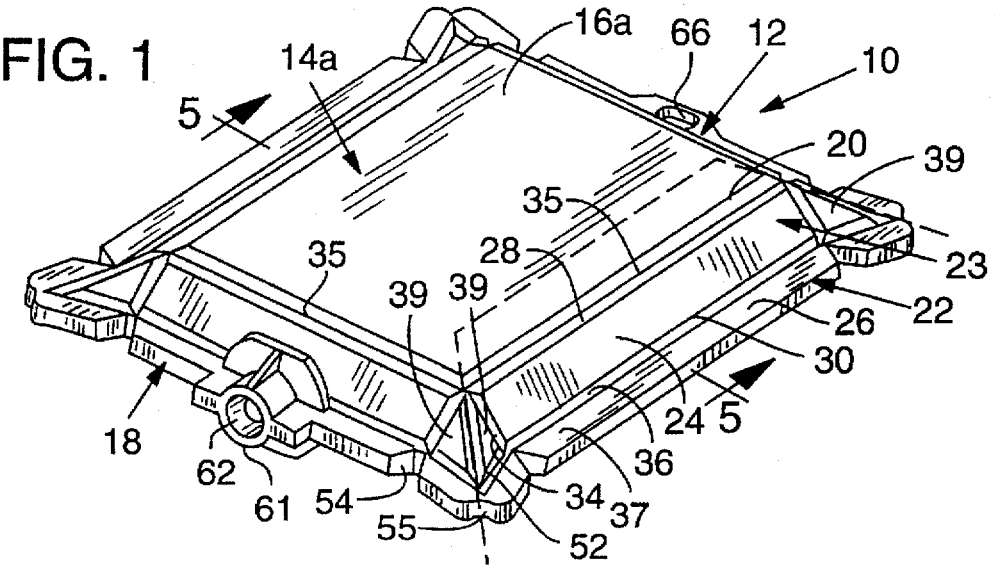
FIG. 1 is a perspective view of a collapsible ink cartridge in accordance with one aspect of the invention.
Figure 2:
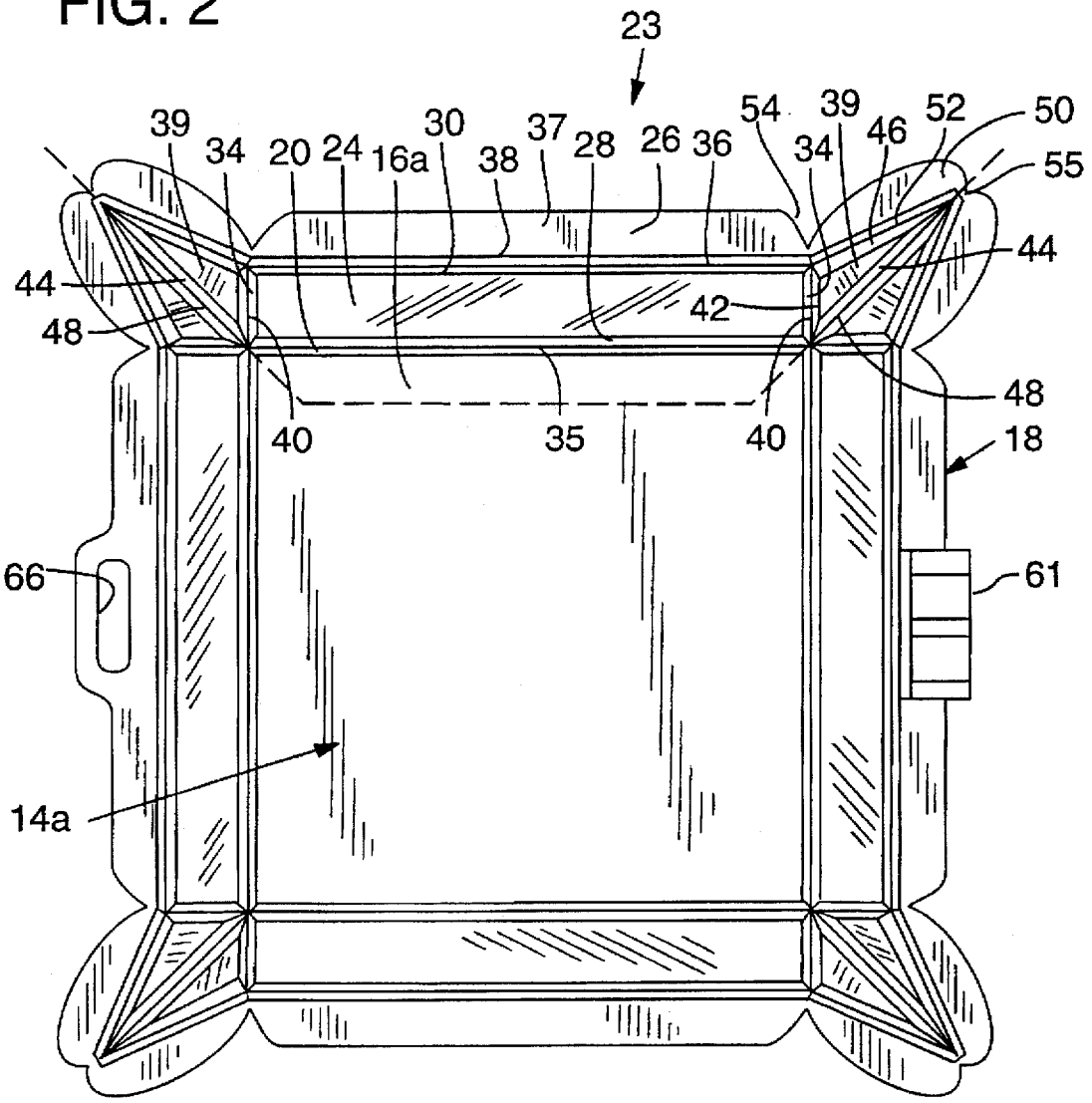
FIG. 2 is a top plan view of the collapsible ink cartridge showing the ink cartridge in a collapsed configuration.

A collapsible ink cartridge in accordance with a preferred embodiment of the present invention is designated in FIG. 1 with reference numeral 10. The ink cartridge 10 includes a body 12 with two substantially identical opposing upper and lower wall panel assemblies 14*a*, 14*b* (see FIG. 3). The opposing wall panel assemblies 14*a*, 14*b* have opposed inner surfaces 15 (see FIG. 5). As shown in FIGS. 1 and 2, each of the panel assemblies 14*a*, 14*b* has a relatively large, square-shaped planar panel 16*a*, 16*b*. The square panels 16*a*, 16*b* respectively define the top and bottom of the cartridge 10. The panel assemblies 14*a*, 14*b* are joined at a square-shaped frame 18 and are, therefore, symmetrical about a central plane defined by the frame 18.

Figure 3:
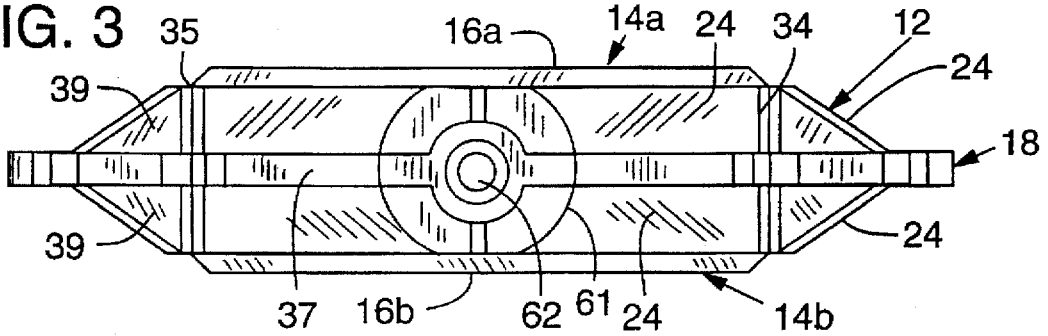
FIG. 3 is a side elevational view of a collapsible ink cartridge.
Figure 4:
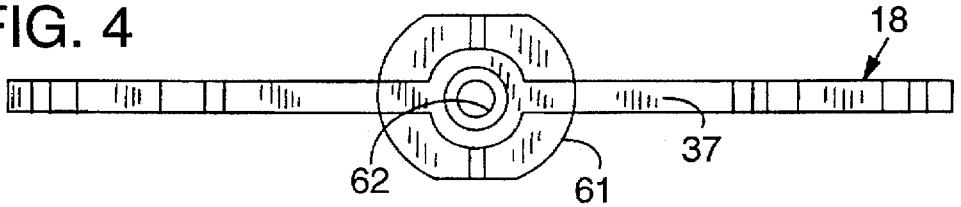
FIG. 4 is a side elevational view of a collapsible ink cartridge showing the ink cartridge in an empty, collapsed configuration.

The cartridge 10 in FIGS. 1 and 3 is shown in a maximum volume or full configuration. In the full configuration, the upper and lower panel assemblies 14*a*, 14*b* extend respectively upward and downward from the frame 18 to define a cavity 19 within the body 12 for the storage of ink (see FIG. 5). The body 12 is collapsible to an empty configuration wherein the upper and lower panel assemblies 14*a*, 14*b* collapse flat against each other within a plane defined by the frame 18 (see FIGS. 2 and 4).

Given the symmetry of the cartridge 10, the following description of the upper panel assembly 14*a* applies equally as well to the lower panel assembly 14*b*.

The upper square panel 16*a* has four identical straight edges 20. The frame 18 has four substantially identical frame side members 22. The square panel 16*a* is positioned with respect to the frame 18 so that the square panel edges 20 align with the frame side members 22. Accordingly, the upper panel assembly 14*a* and the frame 18 have four sides of substantially common construction. One side of common construction is designated by reference numeral 23 and the phantom line of FIGS. 1 and 2. The description of this side 23 applies equally as well to the other three sides of common construction between the upper panel assembly 14*a* and frame 18.

Referring to the side 23, an elongate rectangular edge panel 24 interconnects the square panel 16*a* and an intermediate portion 26 of the frame side member 22. The rectangular edge panel 24 has inner and outer longitudinal edges 28, 30 and end edges 34. The edge panel longitudinal edges 28, 30 are substantially equal in length to the square panel edge 20. The edge panel inner edge 28 is hinged to the square panel edge 20 at a square panel hinge 35. The edge panel outer edge 30 is hinged to the frame intermediate portion 26 at a double hinge 36. As is described below, the edge panels 24 of the symmetrical upper and lower panel assemblies 14*a*, 14*b* attach to the frame intermediate portion 26 at the double hinge 36 (see FIG. 5).

The edge panel 24 extends diagonally between the upper square panel 16*a* and the frame 18 when the cartridge 10 is in the full configuration (see FIG. 3). The edge panel 24 lays flat with the square panel 16*a* within the plane defined by the frame 18 when the cartridge 10 is in the empty configuration (see FIG. 4).

As shown in FIGS. 1 and 2, a triangular (corner) panel 39 is attached to each edge panel end edge 34 at an end hinge 40. To facilitate the description of the triangular panels 39, reference is made to FIG. 2, which shows the panels of the first common side construction 23 flat, in the empty configuration. So viewed, the triangular panel 39 has one 45° angle, one obtuse angle, and one acute angle of less than 45°. The shortest (first) edge 42 of the triangle is defined between the 45° and obtuse angles. The longest (second) edge 44 of the triangle is defined between the 45° and acute angles. A third edge 46 of the triangle is defined between the acute and obtuse angles.

The triangular panel first edge 42 is substantially equal in length to the edge panel end edge 34, and attaches thereto at end hinge 40. The second edge 44 of the triangular panel 39 extends radially outward from the corner of the upper square panel 16*a*. In other words, the line defined by the second triangular panel edge 44 diagonally bisects the upper square panel 16*a*. The diagonally bisecting lines defined by both triangular panel second edges 44 of the common side of construction 23 are mutually perpendicular so that the common side of construction 23 forms a 90° "slice" from the upper panel assembly 14*a*.

The triangular panel third edge 46 extends outward from the edge panel outer edge 30. The third edge 46 is hinged to a frame corner portion 50 at a corner double hinge 52. The frame corner portion 50 is set apart from the frame intermediate portion 26 by an outwardly opening frame side notch 54 that aligns with the end hinge 40. The corner double hinge 52 is substantially identical in construction to frame double hinge 36. The corner double hinge 52 connects the symmetric triangular panels 39 of both the upper and lower panel assemblies 14*a*, 14*b* to the frame corner portion 50.

The common side of construction 23 is integrally attached to adjacent common sides of construction at corner hinges 48. One corner hinge 48 hinges each triangular panel 39 of the common side of construction 23 to an identical triangular panel 39 of an adjacent common side of construction. Each hinged pair of triangular panels 39 attach to the corner hinge 48 at their second edges 44 and extend symmetrically therefrom.

Referring to the entire upper panel assembly 14*a* and frame 18 shown in FIG. 2, pairs of hinged triangular panels 39 are positioned at each corner of the upper panel assembly 14*a*. The pairs of triangular panels 39 project beyond the lines formed by the edge panel outer edges 30. The projection of the pairs of triangular panels 39 permits the edge panel outer edges 30 and the triangular panel third edges 46 to remain within the plane defined by the frame 18 in the full and the empty configurations (see FIGS. 1 and 4).

The frame corner portions 50 of adjacent common sides of construction intersect at a corner notch 55. Thus, the corner hinges 48 extend radially from the corners of the upper wall panel 16*a* to the corner notches 55 at the corners of the frame 18.

In the full configuration, as shown in FIGS. 1 and 3, the edge panels 24 extend diagonally at an angle of about 35° from the plane of the frame 18. The corner hinges 48 extend upwardly from the corners of the frame corner portions 50 to the corners of the upper square panels 16*a*. The triangular panels 39 of adjacent common sides of construction 23 angle downwardly on either side of the corner hinges 48 to the end hinges 40 and the double corner hinges 52.

The material around the frame side and corner notches 54, 55 is resilient. The resilient material permits the frame 18 at the notches 54, 55 to resiliently flex during the collapse of the body 12 from the full configuration (FIG. 1) to the empty configuration (FIG. 2).

As will now be described, the hinges 35, 40, 48 and double hinges 36, 52 flex to permit the inner surfaces 15 of the body 12 (see FIG. 5) to lie flat and smooth against each other in the collapsed empty configuration.

Figure 5:
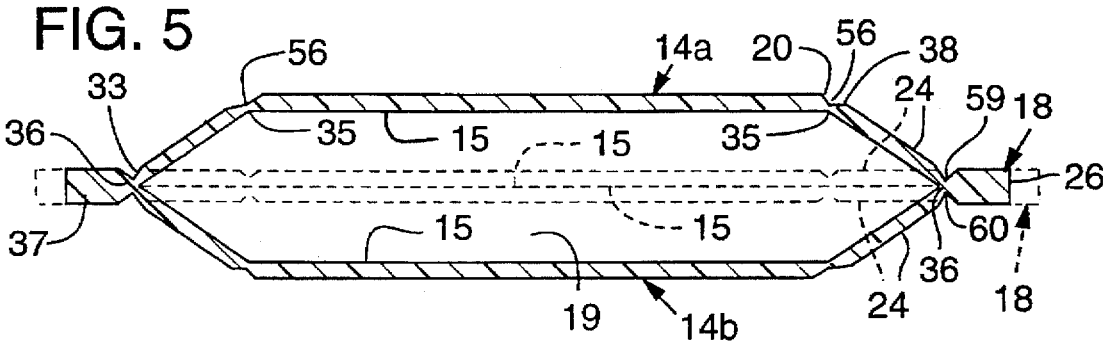
FIG. 5 is a cross-sectional view of a collapsible ink cartridge taken along line 5—5 of FIG. 1.

FIG. 5 shows a cross-section of double hinge 36. The frame intermediate portion 26 and the edge panel outer edge 30 have opposing bevels that form an upper framing groove 59. An identical symmetric lower framing groove 60 is formed between the edge panel 24 of the lower panel assembly 14*b* and the frame intermediate portion 26. A bridge of the frame's resilient material separates the bottoms of the grooves 59, 60. The resilient material flexes to permit the edge panels 24 of the upper and lower panel assemblies 14*a*, 14*b* to pivot together about the frame double hinge 36. The corner double hinge 52 is of similar construction to permit the triangular panels 39 of the upper and lower panel assemblies 14*a*, 14*b* to pivot together.

The hinges 35, 40, 48 between the panels of the common side of construction 23 permit the upper panel assembly 14*a* to collapse flat. FIG. 5 shows a cross-section of an exemplary square panel hinge 35. The hinge 35 includes opposing bevels on the square panel edge 20 and the edge panel inner edge 38 to form a V-shaped hinge groove 56 on the exterior of the panel assembly 14*a*. A narrow bridge of resilient material remains between the bottom of the hinge groove 56 and the inner surface 15 of the panel assembly 14*a*. The panel assembly inner surface 15 is unbroken across the square panel hinge 35.

The edge and corner hinges 40, 48 are of substantially identical construction. Thus, the panel assembly inner surface 15 is completely smooth and flat in the empty configuration. The hinges 35, 40, 48 are identical to the corresponding hinges of the symmetric lower panel assembly 14*b*. Thus, the inner surfaces 15 of both the upper and lower panel assemblies 14*a*, 14*b* are smooth and lie flat against each other in the empty configuration (see phantom in FIG. 5).

The cartridge 10 is filled with ink in the full configuration. One frame intermediate portion 26 is shaped to define a fitment 61 with an orifice 62 through which ink may be conducted in and out of the cartridge (see FIG. 1). The fitment 61 may include a stopper, valve, or pierceable septum (not shown) to occlude the orifice until a tube or other coupler is inserted into the orifice for removing ink. As ink is drawn from the cartridge 10 through the orifice 62, the upper and lower panel assemblies 14*a*, 14*b* collapse toward each other to reduce the volume of the cavity 19. Fitment 61 may also be located on any of the flat planar surfaces as well.

To collapse to the empty configuration shown in FIGS. 2 and 5, the edge panels 24 pivot about the double hinge 36 to lie flat within the plane of the frame 18. The hinges 35 flex as square panel 16*a* moves with the edge panel inner edge 38 inward toward the plane of frame 18. The end hinges 40 and corner hinges 48 flex as the triangular panels 39 pivot about the double corner hinges 52 to lie flat within the frame 18. The panels of the upper and lower panel assemblies 14*a*, 14*b* collapse at the same time and in the same way. Thus, each panel of the upper panel assembly 14*a* is always in vertical alignment with the matching panel of the symmetrical lower panel assembly 14b.

Ink is drawn from the cartridge body 12 until the volume of cavity 19 is completely diminished in the empty configuration. As described above, the unbroken inner surfaces 15 of the upper and lower panel assemblies 14a, 14b lie flat and smooth against each other within the plane of the frame 18 (see phantom in FIG. 5). No voids remain within the body 12 in the empty configuration, so that essentially no ink is retained within the empty cartridge 10.

In a preferred embodiment, the cartridge 10 is constructed so that the frame 18 resiliently flexes and expands (see phantom in FIG. 5) during the collapse of the body 12 from the full configuration to the empty configuration. The collapse of the edge panels 24 forces the frame intermediate portions 26 outwardly. The collapse of the triangular corner panels 39 forces the frame corner portions 50 to pivot open about the corner notches 55 (not shown). Thus, the notches 55 are partially closed. The frame side notches 54 resiliently open as the frame corner portions 50 and the frame intermediate portions 26 move outwardly.

The cartridge 10 is preferably constructed to be biased toward the full configuration. The bias may be accomplished by fabricating the cartridge in the full configuration. As a result, the resilient material of each of the hinges and notches is relaxed when the cartridge 10 is in the full configuration. The resilient material becomes stressed as the cartridge 10 collapses into the empty configuration. The stresses bias the cartridge 10 back to the full configuration. The bias is sufficient to store the ink under a back pressure within the cavity.

Such back pressure is useful in operating ink jet pens that are permanently coupled to the cartridge and require a back pressure to properly deliver ink. The bias is also advantageous in applications where the cartridge has a tube that is periodically coupled with the pen to refill the pen reservoir. In this application, the bias provides a sucking action when the tube is uncoupled from the pen after refilling. The sucking action prevents overfill of the pen by sucking away ink that is free within the pen, and prevents dripping by sucking the ink near the open end of the tube deeper into the tube.

In another aspect of the invention, the elongate frame side members 22 may be longitudinally resilient to provide a bias of the cartridge 10 toward the full configuration. In this case, the side members 22 resiliently flex in tension as the body 12 collapses within the frame 18. The resilient tensile stretching biases the cartridge 10 toward the full configuration.

In applications where the cartridge tube is continuously coupled to the pen and the cartridge is constructed to be biased toward the full configuration, external mechanisms, such as a pump, may be used as necessary for drawing ink from the cartridge. In other applications, such as when the cartridge tube is occasionally coupled to the pen, an actuator may squeeze the upper and lower wall panels of the cartridge together to discharge ink into the pen. Upon completion of the pen refill, the actuator may be retracted a small amount so that the cartridge bias causes ink to be sucked back within the tube.

The ink cartridge 10 is preferably constructed of a single material. In particular, the cartridge 10 may be composed of a single homogenous resin, such as high density polyethylene (HDPE). A cartridge made of such a resin has resilient hinges and notches and relatively rigid panel sections. To provide the bias toward the full configuration, the cartridge 10 may be molded into the full configuration.

The form of the full cartridge 10, as best shown in FIGS. 1 and 3, provides several advantages. The full cartridge 10 is relatively thin, with the flat upper and lower square panels 16a, 16b positioned respectively above and below the fitment 61. Thus, the full cartridges 10 are compactly stackable one on top of another without interference with the fitment 61.

The cartridge 10 also serves as its own package. An opening 66 is formed in the frame intermediate portion 26 opposite the orifice 62 to permit the ink cartridge 10 to be hung on racks for retail display, or for storage. Tough cartridge materials such as HDPE provide protection against damage. The HDPE wall panels are thick enough to minimize ink loss due to ink diffusion through the cartridge body. Furthermore, materials such as HDPE permit product labelling to be molded directly into the cartridge panels.

The construction of the cartridge from a single material facilitates the recycling of empty cartridges. Moreover, the very thin profile of an empty cartridge (see FIG. 4) is advantageous in minimizing the volume of recycled or discarded cartridges. Empty cartridges may be compactly stacked one on top of another if each consecutive cartridge 10 is rotated 90° from the previous cartridge in the stack. In this way, the fitment 61 of the stacked cartridges do not impinge on the fitment 61 of neighboring stacked cartridges.

It should be understood that the construction of the illustrated embodiment may be altered in a variety of ways with equally good results. For instance, rather than square or rectangular, the cartridge may be formed in a variety of shapes, such as a triangle or any polygon.

Furthermore, the shape and number of wall panels may be varied with equally good results. Also, a smooth-membered frame may be provided that dispenses with the notches 54, 55. Such a notchless frame will suffice if sufficiently resilient to permit the outward movement of the individual panels of the collapsing body 12.

While HDPE is a preferred material for the cartridge 10, it is also to be understood that other materials, or combinations of materials, may work as well. For instance, the panel sections may be constructed of a stiff material, while the hinge and notch material is of a resilient material.

The foregoing has been described in connection with preferred and alternative embodiments. It will be appreciated by one of ordinary skill in the art, however, that various modifications and variations may be substituted for the mechanisms and method described here while remaining defined by the appended claims and their equivalents.

The invention claimed is:

1. An ink cartridge for storing ink, comprising:

a body having a plurality of wall panels selectively arranged in a nonplanar orientation to define a full configuration of the body wherein the wall panels define a cavity having a volume for storing ink, the wall panels being collapsible to transition the body from the full configuration to an empty configuration, the empty configuration being defined where the wall panels are collapsed inwardly into the cavity such that the volume of the cavity is diminished; and a resilient frame that surrounds and projects from the body, the body collapsing within the frame in the empty configuration, the frame resiliently expanding as the body collapses, resiliency of the frame urging the body toward the full configuration.

2. An ink cartridge according to claim 1, wherein the body includes grooves formed therein to perimetrically separate individual wall panels, the wall panels being resiliently flexible about the grooves.

3. An ink cartridge according to claim 1, wherein the wall panels include an upper wall panel and a lower wall panel, the upper wall panel and lower wall panel defining a top and a bottom of the cartridge, the upper wall panel and the lower wall panel collapsing flat together when the body collapses into the empty configuration.

4. An ink cartridge according to claim 1, wherein the frame defines a plane, and the body is collapsible flat within the plane in the empty configuration.

5. An ink cartridge according to claim 1, wherein the plurality of wall panels extend from the frame symmetrically.

6. An ink cartridge according to claim 1, wherein the body is made entirely of a single type of material.

7. An ink cartridge according to claim 1, wherein a plurality of notches are formed in the frame, the frame being resiliently flexible adjacent the notches, the notches permitting the frame to resiliently expand as the body collapses.

8. An ink cartridge according to claim 2, wherein the body resiliently flexes along the grooves as the body collapses toward the empty configuration, resiliency of the body biasing the wall panels toward the nonplanar orientation and thereby biasing the body toward the full configuration.

9. An ink cartridge according to claim 2, wherein at least one wall panel pivots about at least one groove to collapse into contact with another opposing wall panel to place the body in the empty configuration.

10. An ink cartridge according to claim 3, wherein the plurality of wall panels includes a plurality of elongate edge panels, the edge panels being positioned around the upper wall panel and interconnecting the upper wall panel and the frame, the edge panels being hinged to the frame, the edge panels extending diagonally downward from the upper wall panel to a plane defined by the frame and the upper wall panel being positioned above the frame when the body is in the full configuration, and the edge panels collapsing to lie flat with the upper wall panel within the plane defined by the frame when the body is in the empty configuration.

11. An ink cartridge according to claim 3, wherein:

the frame is rectangular;

the upper wall panel is rectangular;

the plurality of wall panels including edge wall panels that are elongate and rectangular, the edge wall panels having opposite longitudinal edges and opposite end edges, the longitudinal edges respectively hinged to the upper wall panel and the frame; and the plurality of wall panels including triangular wall panels, the triangular wall panels being hinged together in a pair, defining a corner hinge which extends from a corner of the upper wall panel to a corner of the rectangular frame, each triangular wall panel of the pair extending symmetrically from the corner hinge, each triangular wall panel of the pair being attached to an edge wall panel end edge and the frame.

12. An ink cartridge according to claim 8, wherein bias of the body toward the full configuration creates a vacuum which stores the ink within the cavity under a back pressure.

13. An ink cartridge according to claim 8, wherein a fitment is located on the body, the fitment defining a conduit opening from the cavity for extracting ink, bias of the body toward the full configuration creating a vacuum which sucks ink back through the conduit toward the cavity.

14. An ink cartridge according to claim 8, wherein the body includes opposed wall panels, the opposed wall panels being configured to collapse into contact with each other when the body collapses into the empty configuration.

15. An ink cartridge for storing ink, comprising:

a body having a plurality of wall panels extending symmetrically about a central plane of the body, each of the wall panels being resiliently attached to adjacent wall panels;

the plurality of wall panels including triangular wall panels, the triangular wall panels being resiliently hinged together in pairs to define corresponding corner hinges, each triangular wall panel of a triangular wall panel pair extending symmetrically with another triangular wall panel of a triangular wall panel pair relative to a corresponding hinge, the triangular wall panels also being attached to other of the plurality of wall panels and forming comers of the body;

the body having a full configuration wherein the wall panels define a cavity having a volume for storing ink within the body, and an empty configuration wherein the wall panels collapse inwardly to lie flat against opposing wall panels, the collapse of the body reducing the volume of the cavity.

16. An ink cartridge according the claim 15, wherein the wall panels have inner surfaces defining the cavity, the inner surfaces being unbroken across resilient attachments between adjacent wall panels, the inner surfaces being flat and smooth when the body is in the empty configuration.

17. An ink cartridge according to claim 15, wherein the wall panels include an upper wall panel and a lower wall panel, the upper wall panel and lower wall panel respectively defining a top and a bottom of the cartridge, the upper wall panel and lower wall panel being parallel with the central plane in both the full configuration and the empty configuration of the body, the upper wall panel and the lower wall panel collapsing to lie aligned and flat against each other upon transition of the body to the empty configuration.

18. An ink cartridge according to claim 17, wherein the wall panel inner surfaces collapse flat together to completely diminish the volume of the cavity upon transition of the body to the empty configuration.

* * * * *

UNITED STATES PATENT AND TRADEMARK OFFICE

CERTIFICATE OF CORRECTION

PATENT NO. : 5,691,755
DATED : November 25, 1997
INVENTOR(S) : Pawlowski, Jr. et al.

It is certified that error appears in the above-identified patent and that said Letters Patent is hereby corrected as shown below:

Column 8,
Line 22, delete “each” and insert -- therefor -- one --.
Line 24, delete “a” and insert therefor -- said --.
Line 26, delete “hinge,” and insert therefor -- corner hinge of said corner hinges, --.
Line 27, after “other”, insert -- panels --.
Line 28, delete “comers” and insert therefor -- corners --.
Line 32, after “panels”, insert -- including opposed wall panels --.
Line 33, delete “opposing wall panels,” and insert therefor -- each other, --.

Signed and Sealed this

Third Day of February, 2004

JON W. DUDAS
*Acting Director of the United States Patent and Trademark Office*